US011135640B2

(12) United States Patent
Kim

(10) Patent No.: US 11,135,640 B2
(45) Date of Patent: Oct. 5, 2021

(54) PRESS-TYPE COMPOSITE INTERNALLY AND EXTERNALLY THREADED PORTION FORMING SYSTEM FOR MANUFACTURE OF DRUM BUNGS

(71) Applicant: Mansoo Kim, Seoul (KR)

(72) Inventor: Mansoo Kim, Seoul (KR)

( * ) Notice: Subject to any disclaimer, the term of this patent is extended or adjusted under 35 U.S.C. 154(b) by 210 days.

(21) Appl. No.: 16/264,647

(22) Filed: Jan. 31, 2019

(65) Prior Publication Data

US 2019/0247911 A1 Aug. 15, 2019

(30) Foreign Application Priority Data

Feb. 14, 2018 (KR) ..... 10-2018-0018402

(51) Int. Cl.
*B21D 51/50* (2006.01)
*B21D 51/40* (2006.01)
*B21D 53/24* (2006.01)

(52) U.S. Cl.
CPC ..... *B21D 51/40* (2013.01); *B21D 51/50* (2013.01); *B21D 53/24* (2013.01)

(58) Field of Classification Search
CPC ..... B21D 51/38; B21D 51/44; B21D 51/50; B21D 22/14–16; B23G 7/00; B23G 7/02; Y10T 279/17471
USPC ..... 413/8, 23; 72/353.2, 353.4, 379.4, 72/80–126
See application file for complete search history.

(56) References Cited

U.S. PATENT DOCUMENTS 2,442,965 A 6/1948 Thomas
2,664,136 A * 12/1953 Hornberger ..... B21D 51/50 72/94
3,537,234 A * 11/1970 Mayer ..... B21D 51/50 53/357
4,416,142 A * 11/1983 Thorne-Thomsen .. B21D 51/50 470/84
4,663,837 A * 5/1987 Hoeffken ..... B21D 39/03 29/726
4,893,390 A * 1/1990 Hoeffken ..... B21D 39/06 29/243.518

FOREIGN PATENT DOCUMENTS

JP 57181734 A * 11/1982 ..... B21D 51/50
JP S57-181734 A 11/1982
JP 58070928 A * 4/1983 ..... B21D 51/50
(Continued)

*Primary Examiner* — Debra M Sullivan
*Assistant Examiner* — Dylan Schommer
(74) *Attorney, Agent, or Firm* — KORUS Patent, LLC; Seong Il Jeong

(57) ABSTRACT

The present invention relates to a press-type composite internally and externally threaded portion forming system. In this case, the press-type composite internally and externally threaded portion forming system includes an expansion-type collet core unit (10) and a contraction-type collet core unit (20) as its principal components so that internally and externally threaded portions are formed by means of a press method in a composite manner in such a way that the expansion forming force of the expansion-type collet core unit (10) and the contraction forming force of the contraction-type collet core unit (20) simultaneously act on the inner and outer circumferential surfaces of a workpiece in opposite directions.

9 Claims, 4 Drawing Sheets

(56) References Cited

FOREIGN PATENT DOCUMENTS

| | | | | |
|---|---|---|---|---|
| JP | H05-161935 | A | | 6/1993 |
| JP | H07-051896 | A | | 2/1995 |
| JP | H07-314070 | A | | 12/1995 |
| JP | 10156479 | A | * | 6/1998 |
| JP | H10-156479 | A | | 6/1998 |
| JP | H11-057907 | A | | 3/1999 |
| KR | 10-1092020 | B1 | | 12/2011 |

* cited by examiner

PRESS-TYPE COMPOSITE INTERNALLY AND EXTERNALLY THREADED PORTION FORMING SYSTEM FOR MANUFACTURE OF DRUM BUNGS

CROSS-REFERENCE TO RELATED APPLICATION

This application claims the benefit of Korean Patent Application No. 10-2018-0018402 filed on Feb. 14, 2018, which is hereby incorporated by reference herein in its entirety.

BACKGROUND

1. Technical Field

The present invention relates generally to a press-type composite internally and externally threaded portion forming system, and more specifically to a press-type composite internally and externally threaded portion forming system for the manufacture of drum bungs, by which internally and externally threaded portions are formed by means of a press method in a composite manner in such a way that the expansion forming force of an expansion-type collet core unit and the contraction forming force of a contraction-type collet core unit simultaneously act on the inner and outer circumferential surfaces of a workpiece in opposite directions.

2. Description of the Related Art

In general, a threaded portion is a portion that is formed by cutting a spiral groove on the circular outer circumference of a rod or the inner circumferential surface of a hole and provides coupling force in response to rotating force. Such threaded portions are widely used for the coupling and fastening of machine parts, bungs for containers, etc. Meanwhile, most threaded portions are formed by means of a cutting process including lathe turning, and thus the production efficiency of the threaded portions is low. In particular, in the case of threaded portions used for bungs for containers, such as a drum, problems arise in that the threaded portions are cut and formed even under the conditions that do not require high precision and thus the production efficiency of the threaded portions is low and the manufacturing cost of the threaded portions is high.

Accordingly, Korean Patent No. 10-1092020 discloses a technology in which a cap-shaped female and male bung is formed in an integrated manner by pressing a single metal plate (a raw material) having a predetermined thickness by means of a single mold so that it has a depth, obtained by adding the depth of a female bung and the depth of a male bung selectively opened and closed by the female bung in a threaded manner, without discarding a metal plate, i.e., a central hole portion (a circular scrap) that is cut off and discarded for the entry of a fluid (including a liquid) during a process of forming a female bung that is coupled and fastened to an exit of a drum, the cap-shaped female and male bung is divided into a female blank and a male blank, and an internally threaded portion and an externally threaded portion are formed by means of a thread rolling method. Accordingly, a metal plate (a raw material), i.e., a circular scrap that is discarded during the forming of a female bung, is utilized for a useful purpose. Furthermore, a single metal plate is formed into a female and male bung by means of a thread rolling method, and thus manufacturing cost is reduced and the efficiency of forming work is maximized.

However, although the conventional technology is a technology designed to form a female and male bung for a drum by means of a thread rolling machine, the conventional technology employs a method that forms an external thread in such a way as to insert a material between rotating dies on which thread-shaped protrusions and depressions are formed and applying plastic deformation rather than cutting due to the characteristics of the thread rolling machine, and thus a problem arises in that formation time is delayed.

In addition, when an externally threaded portion is formed, the rotating die for external threads needs to be brought into contact with the outer circumferential surface of a workpiece. In contrast, when an internally threaded portion is formed, the rotating die for internal threads needs to be disposed on and brought into contact with the inner circumferential surface of the workpiece. Accordingly, the formation of an internally threaded portion and the formation of an externally threaded portion are performed by separate machines and/or in separate manufacture lines, and thus the construction of manufacturing equipment requires high cost. In most small companies, the formation of an internally threaded portion and the formation of an externally threaded portion are alternately performed by replacing the rotating dies with each other in a single thread rolling machine. As a result, the switching between the operations is cumbersome, and productivity improvement is limited.

SUMMARY

The present invention has been conceived to overcome the above-described problems, and an object of the present invention is to provide a press-type composite internally and externally threaded portion forming system for the manufacture of drum bungs, by which internally and externally threaded portions are formed by means of a press method in a composite manner in such a way that the expansion forming force of an expansion-type collet core unit and the contraction forming force of a contraction-type collet core unit simultaneously act on the inner and outer circumferential surfaces of a workpiece in opposite directions.

In order to accomplish the above object, the present invention provides a press-type composite internally and externally threaded portion forming system, including: an expansion-type collet core unit (10) configured to be expanded by inclined surface movement performed with respect to an inside cam (1) and to form an internally threaded portion (A1) on the inner circumferential surface of a workpiece (A); a contraction-type collet core unit (20) disposed opposite the expansion-type collet core unit (10), and configured to be contacted by inclined surface movement performed with respect to an outside cam (2) and to form an externally threaded portion (A2) on the outer circumferential surface of the workpiece (A); and a component configured such that the internally and externally threaded portions (A1 and A2) are press-formed in such a way that the expansion forming force of the expansion-type collet core unit (10) and the contraction forming force of the contraction-type collet core unit (20) simultaneously act on the inner and outer circumferential surfaces of the workpiece (A) in opposite directions.

The expansion-type collet core unit (10) may include: a rail block (12) configured to be transferred along the inside cam (1); a plurality of inner-diameter threading cores (14) circularly disposed to be pressed against the inner circumferential surface of the workpiece (A) and configured to form the internally threaded portion (A1); and elastic strips (16) configured to connect the rail block (12) to the inner-diameter threading cores (14); and inclined surfaces (18) configured to perform inclined surface movement with respect to the inside cam (1) may be provided on the inner circumferential surfaces of the inner-diameter threading cores (14).

The contraction-type collet core unit (20) may include: a rail block (22) configured to be transferred along the outside cam (2); a plurality of outer-diameter threading cores (24) circularly disposed to be pressed against the outer circumferential surface of the workpiece (A) and configured to form the externally threaded portion (A2); and elastic strips (26) configured to connect the rail block (22) to the outer-diameter threading cores (24); and inclined surfaces (28) configured to perform inclined surface movement with respect to the outside cam (2) may be provided on the outer circumferential surfaces of the outer-diameter threading cores (24).

When the contraction-type collet core unit (20) is supported on a guide shank (29) and is transferred to a location, where the externally threaded portion (A2) is formed, along the outside cam (2), the contraction-type collet core unit (20) may be contracted by the transfer force of the outside cam (2) and may form the externally threaded portion (A2) on the outer circumferential surface of the workpiece (A).

The outside cam (2) may be provided in a fixed form, and the contraction-type collet core (20) may be provided to be moved into the outside cam (2) by being pressed by means of the transfer force of the inside cam (1) and to form the externally threaded portion (A2) on the outer circumferential surface of the workpiece (A) by means of generated contraction force.

When the contraction-type collet core unit (20) is contracted by inclined surface movement performed with respect to the outside cam (2) and the externally threaded portion (A2) is formed on the outer circumferential surface of the workpiece (A), the contraction-type collet core unit (20) may be spirally moved along the outer circumferential surface of the workpiece (A) along with the outside cam (2).

BRIEF DESCRIPTION OF THE DRAWINGS

The above and other objects, features, and advantages of the present invention will be more clearly understood from the following detailed description taken in conjunction with the accompanying drawings, in which.

DETAILED DESCRIPTION

Preferred embodiments of the present invention will be described in detail below with reference to the accompanying drawings.

Figure 1:
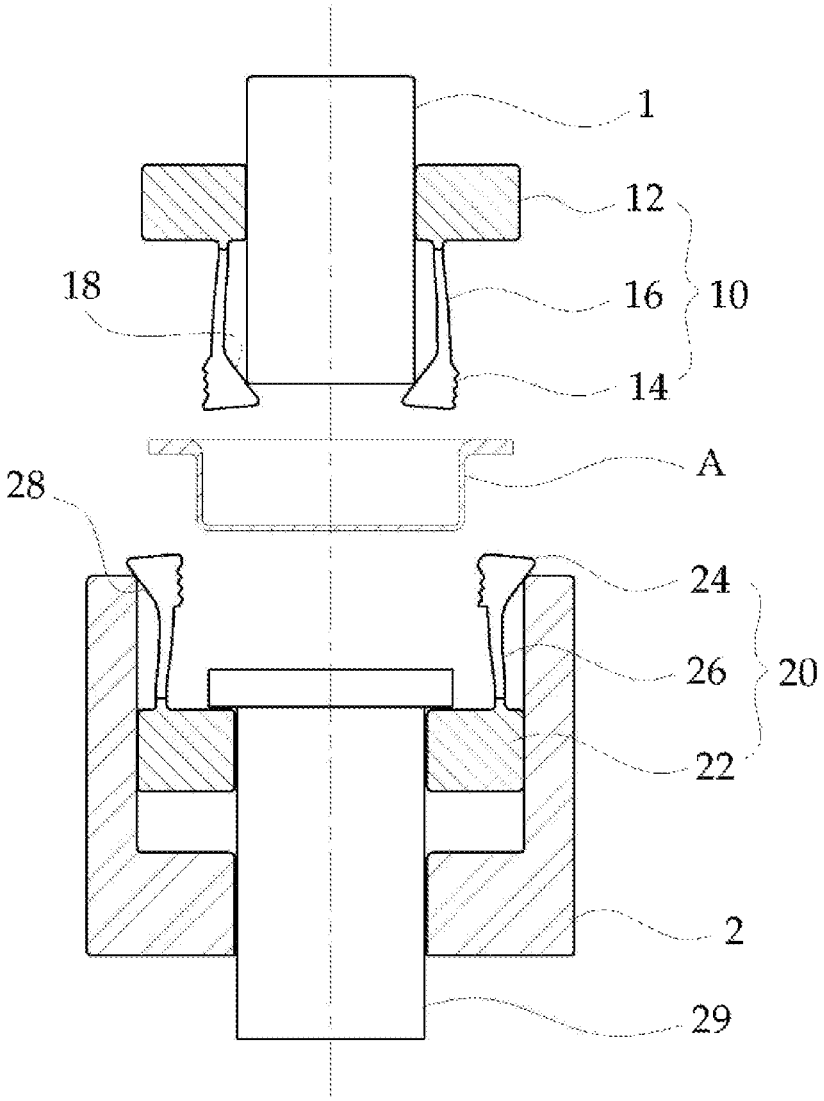
FIG. 1 is a view showing the overall configuration of a press-type composite internally and externally threaded portion forming system according to an embodiment of the present invention.
Figure 2:
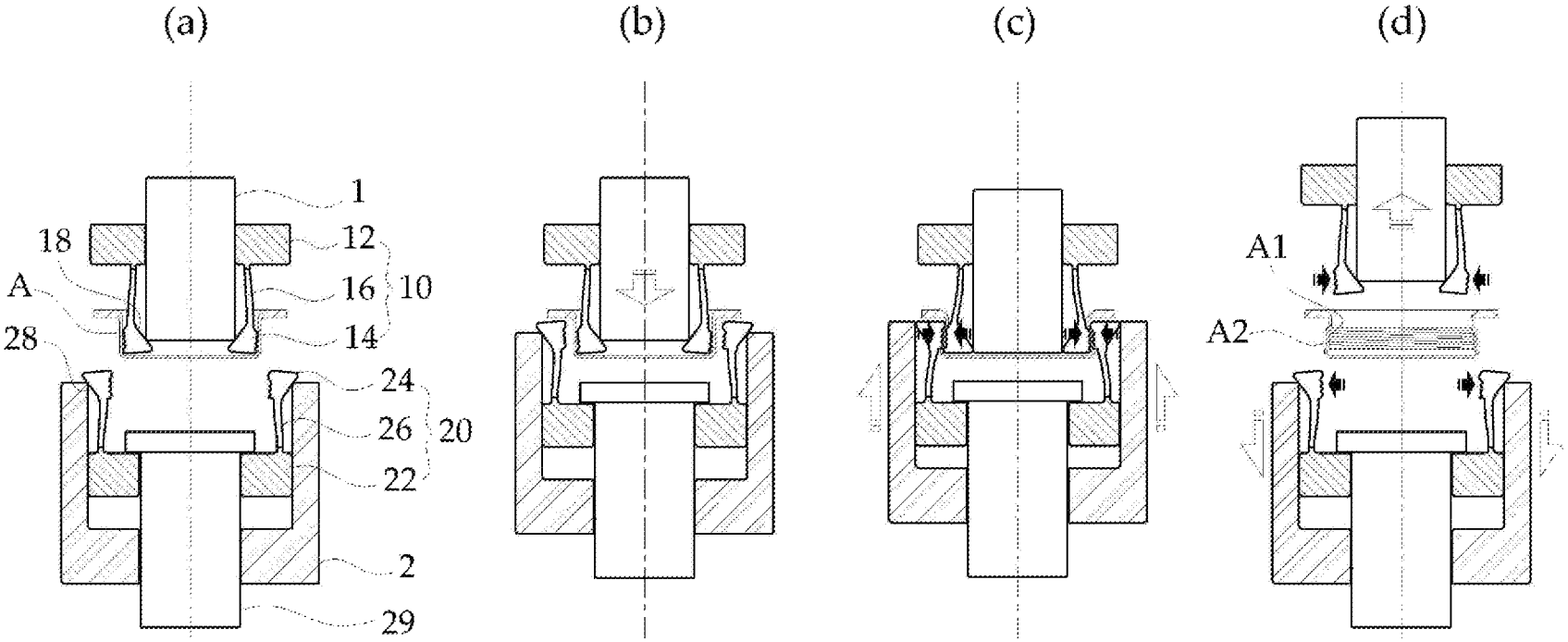
FIG. 2 is a view showing the operation sequence of the press-type composite internally and externally threaded portion forming system according to the embodiment of the present invention.
Figure 3:
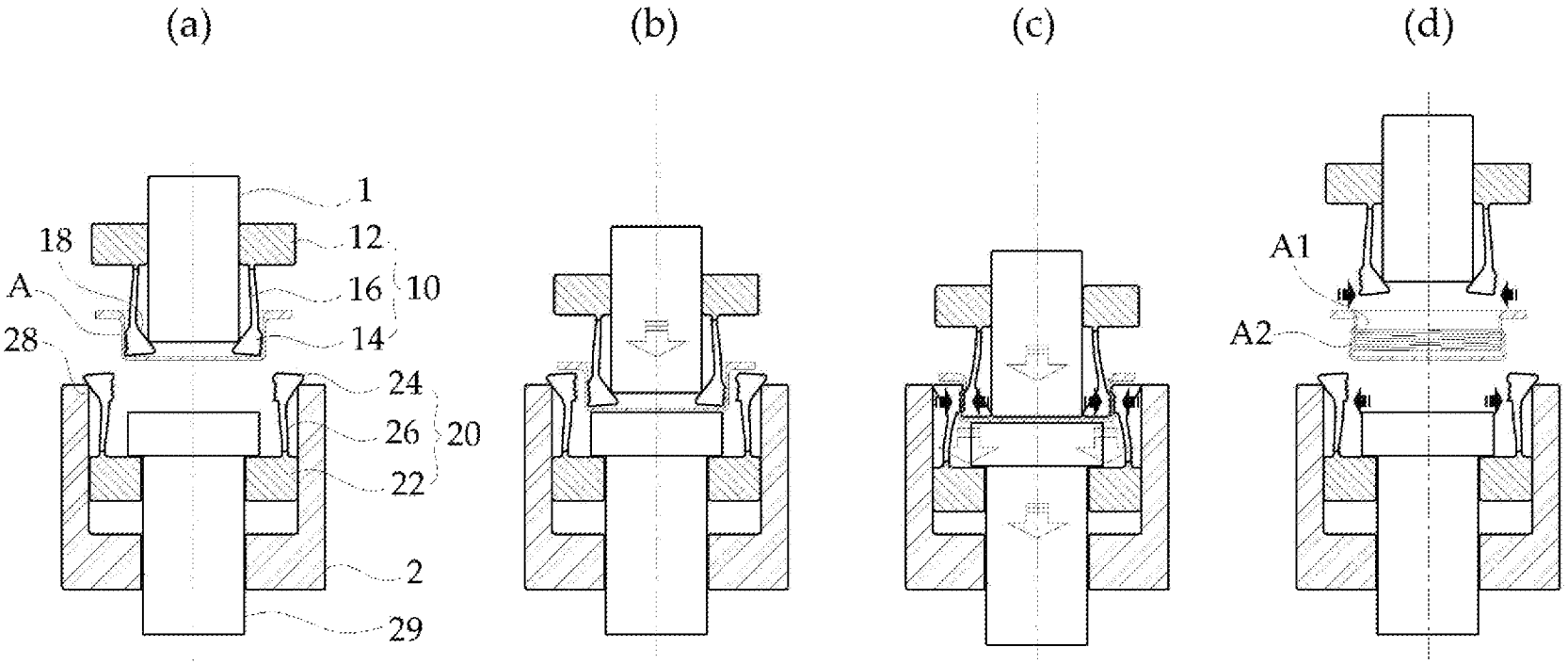
FIG. 3 is a view showing the operation sequence of a press-type composite internally and externally threaded portion forming system according to another embodiment of the present invention.
Figure 4:
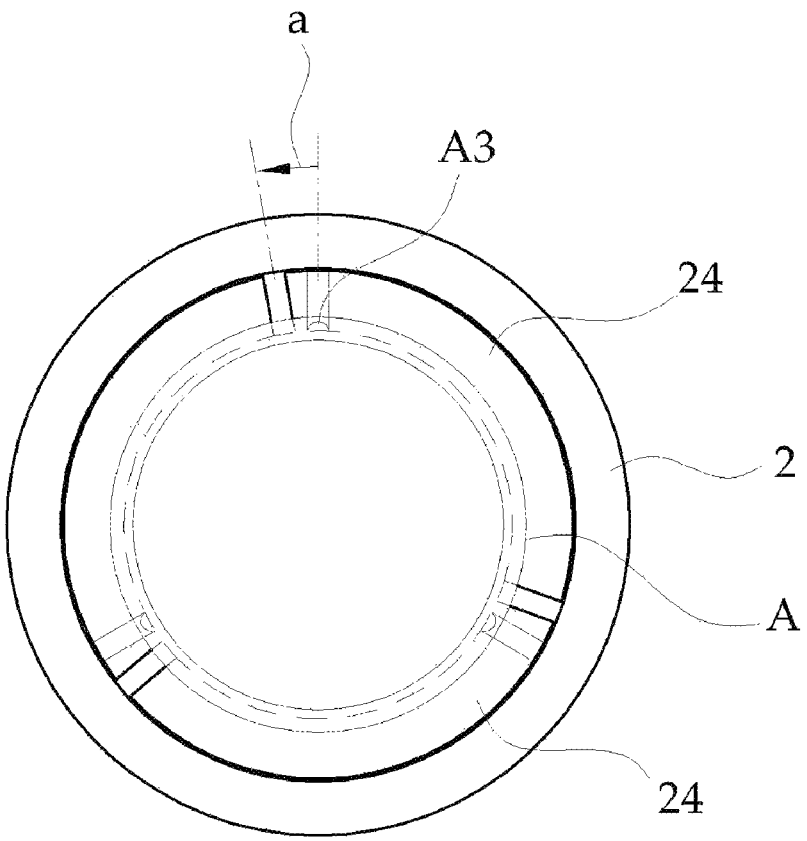
FIG. 4 is a view showing the state of the spiral movement of the contraction-type collet core unit of the press-type composite internally and externally threaded portion forming system according to the other embodiment of the present invention.

FIG. 1 is a view showing the overall configuration of a press-type composite internally and externally threaded portion forming system according to an embodiment of the present invention, FIG. 2 is a view showing the operation sequence of the press-type composite internally and externally threaded portion forming system according to the embodiment of the present invention, FIG. 3 is a view showing the operation sequence of a press-type composite internally and externally threaded portion forming system according to another embodiment of the present invention, and FIG. 4 is a view showing the state of the spiral movement of the contraction-type collet core unit of the press-type composite internally and externally threaded portion forming system according to the other embodiment of the present invention.

The present invention relates to a press-type composite internally and externally threaded portion forming system. In this case, the press-type composite internally and externally threaded portion forming system includes an expansion-type collet core unit 10 and a contraction-type collet core unit 20 as its principal components so that internally and externally threaded portions are formed by means of a press method in a composite manner in such a way that the expansion forming force of the expansion-type collet core unit 10 and the contraction forming force of the contraction-type collet core unit 20 simultaneously act on the inner and outer circumferential surfaces of a workpiece in opposite directions. Meanwhile, although the workpiece A will be described as a cup-shaped bung for a drum by way of example in the following description, the present invention is not limited thereto, but may be widely applied to parts in each of which internally and externally threaded portions are formed on the inner and outer circumferential surfaces of a tubular material.

The expansion-type collet core unit 10 according to the present invention is provided to be expanded by inclined surface movement performed with respect to an inside cam 1 and to form an internally threaded portion A1 on the inner circumferential surface of the workpiece A. The expansion-type collet core unit 10 includes: a rail block 12 configured to be transferred along the inside cam 1; a plurality of inner-diameter threading cores 14 circularly disposed to be pressed against the inner circumferential surface of the workpiece A and configured to form the internally threaded portion A1; and elastic strips 16 configured to connect the rail block 12 to the inner-diameter threading cores 14. In this case, inclined surfaces 18 configured to perform inclined surface movement with respect to the inside cam 1 are provided on the inner circumferential surfaces of the inner-diameter threading cores 14. Meanwhile, an external thread-shaped die configured to form the internally threaded portion A1 is formed on the outer circumferential surfaces of the inner-diameter threading cores 14.

In this case, the inner-diameter threading cores 14 are spaced apart from one another at at least three locations at regular intervals, and are provided such that contraction force is applied to the inner-diameter threading cores 14 by the elastic strips 16. Accordingly, when the expansion-type collet core unit 10 enters the inside of the workpiece A, the plurality of inner-diameter threading cores 14 is contracted and enters without interference. Thereafter, when the inside cam 1 is transferred downward, the inclined surfaces 18 provided on the inner circumferential surfaces of the inner-diameter threading cores 14 perform inclined surface movement with respect to the inside cam 1, and thus the plurality of inner-diameter threading cores 14 is expanded and transferred and is then pressed against the inner circumferential surface of the workpiece A, thereby forming the internally threaded portion A1.

Furthermore, the rail block 12 is formed to have an outer diameter larger than that of the inner-diameter threading cores 14, and is used as a stopper that determines the depth of entry into the workpiece A. In mass production, the depth of entry into workpieces A is maintained at a predetermined value by the rail block 12, and thus the forming quality of the internally threaded portion A1 is maintained at a uniform level.

Meanwhile, the rail block 12 is provided such that the operating distance thereof is limited by a stop ring and a return spring provided on the outer circumferential surface of the inside cam 1. In other words, the rail block 12 is caught on the stop ring at a location where the expansion force of the inner-diameter threading cores 14 has been released by the upward transfer of the inside cam 1, and is easily separated in the workpiece A while being transferred upward along with the inside cam 1.

Referring to FIG. 1, the contraction-type collet core unit 20 according to the present invention is disposed opposite the expansion-type collet core unit 10, and is contracted by inclined surface movement performed with respect to an outside cam 2 and forms an externally threaded portion A2 on the outer circumferential surface of the workpiece A. The contraction-type collet core unit 20 includes: a rail block 22 configured to be transferred along the outside cam 2; a plurality of outer-diameter threading cores 24 circularly disposed to be pressed against the outer circumferential surface of the workpiece A and configured to form the externally threaded portion A2; and elastic strips 26 configured to connect the rail block 22 to the outer-diameter threading cores 24. In this case, inclined surfaces 28 configured to perform inclined surface movement with respect to the outside cam 2 are provided on the outer circumferential surfaces of the outer-diameter threading cores 24. Meanwhile, an internal thread-shaped die configured to form the externally threaded portion A2 is formed on the inner circumferential surfaces of the outer-diameter threading cores 24.

In this case, the outer-diameter threading cores 24 are spaced apart from one another at at least three locations at regular intervals, and are provided such that contraction force is applied to the outer-diameter threading cores 24 by the elastic strips 26. Accordingly, when the outer circumferential surface of the workpiece A is inserted into the contraction-type collet core unit 20, the plurality of outer-diameter threading cores 24 is accommodated in the state of having been elastically expanded. Thereafter, when the outside cam 2 is transferred upward, the inclined surfaces 28 provided on the outer circumferential surfaces of the outer-diameter threading cores 24 perform inclined surface movement with respect to the outside cam 2, and thus the plurality of outer-diameter threading cores 24 is contracted and transferred and is then pressed against the outer circumferential surface of the workpiece A, thereby forming the externally threaded portion A2.

Meanwhile, the rail block 22 is inserted into the inner circumferential surface of the outside cam 2 and is provided to be elastically supported upward by a return spring. Accordingly, in an interval where contraction force is not applied by the outside cam 2, the rail block 22 is always elastically supported upward, and thus the plurality of outer-diameter threading cores 24 waits in the state of having been expanded.

Furthermore, the internally and externally threaded portions A1 and A2 are formed by means of a press method in a composite manner in such a way that the expansion forming force of the expansion-type collet core unit 10 and the contraction forming force of the contraction-type collet core unit 20 simultaneously act on the inner and outer circumferential surfaces of the workpiece A in opposite directions. In other words, as the inner-diameter and outer-diameter threading cores 14 and 24 are expanded or contracted in a lateral direction by the upward and downward pressing forces of the inside and outside cams 1 and 2, the inner and outer circumferential surfaces of the workpiece A are simultaneously pressed. In this case, the internal thread- and external thread-shaped dies of the inner-diameter and outer-diameter threading cores 14 and 24 are engaged with each other with the workpiece A disposed therebetween at a location where they mesh with each other, and thus the internally and externally threaded portions A1 and A2 are simply and rapidly press-formed.

As an example, when the contraction-type collet core unit 20 is supported on a guide shank 29 and is transferred to a location, where the externally threaded portion A2 is formed, along the outside cam 2, the contraction-type collet core unit 20 is contracted by the transfer force of the outside cam 2 and forms the externally threaded portion A2 on the outer circumferential surface of the workpiece A. In other words, when a formed article A is clamped by the expansion force of the expansion-type collet core unit 10 transferred downward along with the inside cam 1, as shown in FIG. 2(*a*), and then the contraction-type collet core unit 20 is transferred upward by the operation force of the guide shank 29 and the inner circumferential surfaces of the outer-diameter threading cores 24 are located at a height corresponding to the inner-diameter threading cores 14 of the expansion-type collet core unit 10, as shown in FIG. 2(*b*), the internally and externally threaded portions A1 and A2 are rapidly formed by means of a press method in a composite manner in such a way that the expansion forming force of the expansion-type collet core unit 10 generated by the downward transfer of the inside cam 1 and the contraction forming force of the contraction-type collet core unit 20 generated by the upward transfer of the outside cam 2 simultaneously act on the inner and outer circumferential surfaces of the workpiece A in opposite directions, as shown in FIG. 2(*c*). Thereafter, as shown in FIG. 2(*d*), when the inside and outside cams 1 and 2 are operated in the reverse sequence of the above-described operation sequence, the expansion-type collet core unit 10 is contacted and the contraction-type collet core unit 20 is expanded, and thus the workpiece A on which the internally and externally threaded portions A1 and A2 have been formed is conveniently discharged.

In another embodiment, the outside cam 2 is provided in a fixed form, and the contraction-type collet core unit 20 is provided to be moved into the outside cam 2 by being pressed by means of the transfer force of the inside cam 1 and to form the externally threaded portion A2 on the outer circumferential surface of the workpiece A by means of generated contraction force. When the bottom surface of the inside cam 1 presses the guide shank 29 of the contraction-type collet core unit 20 or the top surface of the rail block 22 in the state in which the formed article A has been clamped by the expansion force of the expansion-type collet core unit 10 transferred downward along with the inside cam 1, as shown in FIG. 3(*a*), the contraction-type collet core unit 20 is moved downward and the inclined surfaces 28 perform inclined surface movement with respect to the fixed outside cam 2, as shown in FIG. 3(*b*), and the internally and externally threaded portions A1 and A2 are rapidly formed by means of a press method in a composite manner in such a way that the expansion forming force of the expansion-type collet core unit 10 generated by the downward transfer of the inside cam 1 and the contraction forming force of the contraction-type collet core unit 20 generated by the outside cam 2 simultaneously act on the inner and outer circumferential surfaces of the workpiece A in opposite directions, as shown in FIG. 3(*c*). Thereafter, as shown in FIG. 3(*d*), when the inside and outside cams 1 and 2 are operated in the reverse sequence of the above-described operation sequence, the expansion-type collet core unit 10 is contracted and the contraction-type collet core unit 20 is expanded, and thus the workpiece A on which the internally and externally threaded portions A1 and A2 have been formed is conveniently discharged. In this case, the contraction-type collet core unit 20 is provided such that it is elastically supported upward on the fixed outside cam 2 by an elastic element.

Furthermore, when the contraction-type collet core unit 20 is contracted by inclined surface movement performed with respect to the outside cam 2 and the externally threaded portion A2 is formed on the outer circumferential surface of the workpiece A, the contraction-type collet core unit 20 is spirally moved along the outer circumferential surface of the workpiece A along with the outside cam 2. In the steps shown in FIGS. 2(*c*) and 3(*c*), the contraction-type collet core unit 20 is spirally moved along with the outside cam 2. As shown in FIG. 4, the contraction-type collet core unit 20 is spirally moved within the range "a" of 1 to 10°.

Accordingly, even in the case where a non-formed section A3 is generated in the externally threaded portion A2 due to a gap among the plurality of threading cores 24 when the externally threaded portion A2 is formed by means of the contraction force of the contraction-type collet core unit 20, an advantage arises in that the overall externally threaded portion A2 is accurately formed without a non-formed section by a tapping operation resulting from the spiral movement of the contraction-type collet core unit 20.

Meanwhile, the threading cores 24 of the contraction-type collet core unit 20 are each coupled to the inner circumferential surface of the outside cam 2 by a key and a key seat, and thus the movement of the threading cores 24 is allowed in a vertical direction but is blocked in a lateral direction. Accordingly, when spiral movement force is applied to the outside cam 2, the contraction-type collet core unit 20 also performs spiral movement.

The above-described structure may be advantageously applied particularly to the forming of the screws of a bung for a drum.

In accordance with the configuration and operation of the press-type composite internally and externally threaded portion forming system for the manufacture of drum bungs according to the present invention, internally and externally threaded portions are formed by means of a press method in a composite manner in such a way that the expansion forming force of the expansion-type collet core unit and the contraction forming force of the contraction-type collet core unit simultaneously act on the inner and outer circumferential surfaces of a workpiece in opposite directions. In other words, an advantage arises in that the internal thread- and external thread-shaped dies of the inner-diameter and outer-diameter threading cores are pressed with a workpiece disposed therebetween at a location where the internal thread- and external thread-shaped dies are engaged with each other and thus internally and externally threaded portions are simply and rapidly formed.

What is claimed is:

1. A press-type composite internally and externally threaded portion forming system, comprising:

an expansion-type collet core unit (10) configured to be expanded by inclined surface movement performed with respect to an inside cam (1) and to form an internally threaded portion (A1) on an inner circumferential surface of a workpiece (A);

a contraction-type collet core unit (20) disposed opposite the expansion-type collet core unit (10), and configured to be contacted by inclined surface movement performed with respect to an outside cam (2) and to form an externally threaded portion (A2) on an outer circumferential surface of the workpiece (A); and a component configured such that the internally and externally threaded portions (Al and A2) are press-formed in such a way that expansion forming force of the expansion-type collet core unit (10) and contraction forming force of the contraction-type collet core unit (20) simultaneously act on the inner and outer circumferential surfaces of the workpiece (A) in opposite directions, wherein the contraction-type collet core unit (20) is configured such that, when the contraction-type collet core unit (20) is contracted by inclined surface movement performed with respect to the outside cam (2) and the externally threaded portion (A2) is formed on the outer circumferential surface of the workpiece (A), the contraction-type collet core unit (20) is spirally moved along the outer circumferential surface of the workpiece (A) along with the outside cam (2).

2. The press-type composite internally and externally threaded portion forming system of claim 1, wherein:

the expansion-type collet core unit (10) comprises: a rail block (12) configured to be transferred along the inside cam (1); a plurality of inner-diameter threading cores (14) circularly disposed to be pressed against the inner circumferential surface of the workpiece (A) and configured to form the internally threaded portion (Al); and elastic strips (16) configured to connect the rail block (12) to the inner-diameter threading cores (14); and inclined surfaces (18) configured to perform inclined surface movement with respect to the inside cam (1) are provided on inner circumferential surfaces of the inner-diameter threading cores (14).

3. The press-type composite internally and externally threaded portion forming system of claim 1, wherein:

the contraction-type collet core unit (20) comprises: a rail block (22) configured to be transferred along the outside cam (2); a plurality of outer-diameter threading cores (24) circularly disposed to be pressed against the outer circumferential surface of the workpiece (A) and configured to form the externally threaded portion (A2); and elastic strips (26) configured to connect the rail block (22) to the outer-diameter threading cores (24); and inclined surfaces (28) configured to perform inclined surface movement with respect to the outside cam (2) are provided on outer circumferential surfaces of the outer-diameter threading cores (24).

4. The press-type composite internally and externally threaded portion forming system of claim 1, wherein the contraction-type collet core unit (20) is configured such that, when the contraction-type collet core unit (20) is supported on a guide shank (29) and is transferred to a location, where the externally threaded portion (A2) is formed, along the outside cam (2), the contraction-type collet core unit (20) is contracted by transfer force of the outside cam (2) and forms the externally threaded portion (A2) on the outer circumferential surface of the workpiece (A).

5. The press-type composite internally and externally threaded portion forming system of claim 2, wherein the contraction-type collet core unit (20) is configured such that, when the contraction-type collet core unit (20) is supported on a guide shank (29) and is transferred to a location, where the externally threaded portion (A2) is formed, along the outside cam (2), the contraction-type collet core unit (20) is contracted by transfer force of the outside cam (2) and forms the externally threaded portion (A2) on the outer circumferential surface of the workpiece (A).

6. The press-type composite internally and externally threaded portion forming system of claim 3, wherein the contraction-type collet core unit (20) is configured such that, when the contraction-type collet core unit (20) is supported on a guide shank (29) and is transferred to a location, where the externally threaded portion (A2) is formed, along the outside cam (2), the contraction-type collet core unit (20) is contracted by transfer force of the outside cam (2) and forms the externally threaded portion (A2) on the outer circumferential surface of the workpiece (A).

7. The press-type composite internally and externally threaded portion forming system of claim 1, wherein the contraction-type collet core unit (20) is configured such that, the outside cam (2) is provided in a fixed form, and the contraction-type collet core (20) is provided to be moved into the outside cam (2) by being pressed by means of transfer force of the inside cam (1) and to form the externally threaded portion (A2) on the outer circumferential surface of the workpiece (A) by means of generated contraction force.

8. The press-type composite internally and externally threaded portion forming system of claim 2, wherein the contraction-type collet core unit (20) is configured such that, the outside cam (2) is provided in a fixed form, and the contraction-type collet core (20) is provided to be moved into the outside cam (2) by being pressed by means of transfer force of the inside cam (1) and to form the externally threaded portion (A2) on the outer circumferential surface of the workpiece (A) by means of generated contraction force.

9. The press-type composite internally and externally threaded portion forming system of claim 3, wherein the contraction-type collet core unit (20) is configured such that, the outside cam (2) is provided in a fixed form, and the contraction-type collet core (20) is provided to be moved into the outside cam (2) by being pressed by means of transfer force of the inside cam (1) and to form the externally threaded portion (A2) on the outer circumferential surface of the workpiece (A) by means of generated contraction force.

* * * * *